US005235881A

United States Patent [19]

Sano et al.

[11] Patent Number: 5,235,881

[45] Date of Patent: Aug. 17, 1993

[54] PIERCING DIE WHOSE PUNCH HAS DIFFERENT AMOUNTS OF CHAMFER AT DIFFERENT OUTER PERIPHERAL EDGE PORTIONS

[75] Inventors: Kazuhiro Sano, Aichi; Yutaka Suzuki; Shingo Nishimura, both of Toyota, all of Japan

[73] Assignee: Toyota Jidosha Kabushiki Kaisha, Toyota, Japan

[21] Appl. No.: 873,120

[22] Filed: Apr. 24, 1992

[30] Foreign Application Priority Data

Apr. 26, 1991 [JP] Japan ..... 3-095931
Nov. 25, 1991 [JP] Japan ..... 3-309121

[51] Int. Cl.[5] ..... B26F 1/14

[52] U.S. Cl. ..... 83/55; 83/685; 83/686; 83/689; 72/333; 72/338

[58] Field of Search ..... 83/55, 685, 686, 688, 83/689; 72/333, 338

[56] References Cited

U.S. PATENT DOCUMENTS 3,320,843 5/1967 Schott, Jr. ..... 83/689 X
4,905,557 3/1990 Adleman ..... 83/689 X

FOREIGN PATENT DOCUMENTS 887471 8/1953 Fed. Rep. of Germany ..... 83/686
1045765 12/1958 Fed. Rep. of Germany ..... 83/686
54-24388 2/1979 Japan ..... 83/55
57-160836 10/1982 Japan .
59-66934 4/1984 Japan .
1-293922 11/1989 Japan .
442872 9/1974 U.S.S.R. ..... 72/333
1450615 9/1976 United Kingdom .

OTHER PUBLICATIONS

"Standardizing the Design of Punching Dies"; Machinery; Nov., 1963; pp. 90–93.
Search Report dated Jul. 24, 1992.

*Primary Examiner*—Frank T. Yost
*Assistant Examiner*—Raymond D. Woods
*Attorney, Agent, or Firm*—Finnegan, Henderson, Farabow, Garrett & Dunner

[57] ABSTRACT

A piercing die including a punch and a die cooperating with each other to effect a piercing operation on a metallic workpiece sheet, the punch having an outer peripheral edge having a closed profile at a working end thereof. The outer peripheral edge of the punch has a first and a second chamfered portion which are formed such that the amount of chamfer of the first chamfered portion is larger than that of the second chamfered portion. The first and second chamfered portions are formed along large-curvature and small-curvature portions of the closed profile of the punch, respectively, and/or along acute and obtuse outer peripheral portions of the punch whose working end face is inclined with respect to the direction perpendicular to the piercing direction. A piercing method using the punch and die is also included.

11 Claims, 12 Drawing Sheets

PIERCING DIE WHOSE PUNCH HAS DIFFERENT AMOUNTS OF CHAMFER AT DIFFERENT OUTER PERIPHERAL EDGE PORTIONS

BACKGROUND OF THE INVENTION

1. Field of the Invention

The present invention relates in general to a piercing die and a piercing method for piercing a metallic workpiece sheet, and more particularly, to such piercing die and method using an edge-chamfered punch that permits a piercing operation without burrs on the obtained product.

2. Discussion of the Prior Art

In the art of manufacture of automotive components such as a door panel and a hood panel by press-forming techniques, there has been used a piercing die which has a punch block movable in a piercing direction, and a die block disposed below the punch block. The punch block carries a punch, while the die block supports a die having a die hole into which the punch is moved with a suitable clearance, to perform a piercing operation on a workpiece in the form of a sheet or strip.

The piercing operation is performed such that the punch is lowered onto the workpiece sheet placed on the die block, whereby an appropriate portion of the workpiece sheet is subjected to a shearing stress due to a shearing action caused by the edges of the punch and die, when the punch penetrates into the sheet and the sheet bulges into the die hole. As a result, cracking occurs on the workpiece sheet, starting from at least one of the opposite surfaces of the sheet which contact the punch and die, respectively. As the piercing movement of the punch relative to the die progresses, a portion of the sheet corresponding to the periphery of the punch is removed. Thus, the workpiece sheet is pierced, and a pierced product is obtained.

However, the cracking of the sheet may occur either at the edge of the hole to be formed by piercing, i.e., near the edge of the die hole, or alternatively at the edge of the portion of the sheet to be removed, i.e., near the edge of the punch. Namely, the portion at which rupture occurs may be on the side of the punch or die. If the rupture occurs on the side of the punch, the obtained pierced product has burrs along the edge of the hole formed by piercing.

To assure burr-free piercing or blanking operation, it is known to round or chamfer the edge of one of the punch and die which corresponds to the product to be obtained by the piercing or blanking operation, as disclosed in laid-open Publication No. 1-293922 of unexamined Japanese Patent Application. For example, the edge of the punch is chamfered while the edge of the die remains sharp, so that the edge of the hole formed through the pierced product is free of burrs.

More specifically described by reference to FIGS. 8 and 9, a punch 51 has the lower working end whose outer periphery is chamfered, while a die 52 has a die hole whose edge 55 remains sharp. In this arrangement, a shearing stress is concentrated on a portion of a metallic workpiece sheet 56 near the sharp edge of the die 52, whereby cracking tends to take place at that portion of the sheet 56 near the die edge 55, starting from the lower surface of the workpiece sheet 56, as shown in FIG. 9. Consequently, the sheet 56 tends to rupture at the cracked portion near the sharp edge of the die 52, so that the pierced product having a hole is less likely to have burrs along the edge of the hole, while the burrs are likely to be formed along the edge of the removed portion of the sheet 56, namely, left on the scrap. Reference numeral 59 denotes a stripper for holding the workpiece sheet 56 against the die 52.

A graph in FIG. 10 indicates reduction in the height of the burrs left on the product obtained by the punch 51 and die 52 of FIGS. 8 and 9, as compared with that obtained by the conventional ordinary punch and die. The height of the burrs varies with the percent (%) of the clearance between the punch and die with respect to the thickness of the workpiece sheet 56.

The workpiece sheet 56 is made of a metallic material such as steel, aluminum, copper, zinc, titanium or alloys thereof, for example, and has a thickness between 0.2 mm and 6 mm. The amount of chamfer formed along the periphery of the lower end of the punch 52 should be at least 0.2 mm, and preferably smaller than a value close to the thickness of the workpiece sheet 56. While the edge 5 of the die 52 should be sharp, the die edge 55 may be rounded, but the radius of the rounded edge 55 should not exceed 0.15 mm.

However, the present applicants found a drawback on the known arrangement of FIGS. 8 and 9, when the punch and die 51, 52 are used to effect a piercing operation in which a non-circular hole such as a rectangle or ellipse having portions with different curvatures is formed through the workpiece sheet 56, by using the punch and die 51, 52 whose configurations correspond to that of the hole to be formed. That is, it was found that the pierced product had a considerable amount of burrs at portions of the formed hole where curvatures are relatively large.

While the mechanism for the drawback is not clear to the applicants, it is presumed that a portion of the sheet 56 which corresponds to a portion of the punch 51 (die 52) having a relatively small curvature is subjected to reduction in its thickness, due to pressure of the punch 51 acting on that portion squeezed between the punch 51 and the die 52 as a result of the lowering movement of the punch 51. When the thickness of that squeezed portion is eventually reduced below a given value, the sheet 56 undergoes cracking and then rupture at a part thereof near the sharp die edge 55. On the other hand, a portion of the sheet 56 corresponding to a portion of the punch 51 which has a relatively large curvature, for example, a portion of the sheet 56 corresponding to a corner of a rectangular profile of the punch 51 (die 52), tends to have a larger thickness than the portion corresponding to the portion of the punch 51 having the relatively small curvature. This larger thickness seems to arise from a flow of the material toward the large-curvature portions of the punch 51 and die 52, which flow occurs in the direction perpendicular to the piercing direction. As a result, the portions of the material of the sheet 56 near the large-curvature portions (e.g., corner portions) of the die edge 55 are less likely to have reduced thickness, than the other portions near the small-curvature portions of the die edge 55. In other words, the reduction of the material thickness at the portions corresponding to the large-curvature portions of the die edge 55 is delayed with respect to that at the portions corresponding to the small-curvature portions of the die edge 55, whereby there may arise cracking and then rupture of the material at the portions of the material near the large-curvature portions of the punch 51, before cracking of the portions of the material near the large-curvature portions of the die edge 55, due to a tensile stress at the former portions exceeding a threshold value. Namely, the portions of the material near the large-curvature portions of the die edge 55 would not crack before rupturing, but the portions of the material near the large-curvature portions of the punch 51 first cracks and then ruptures. FIG. 11 shows cracking of the sheet 56 relatively near the punch 51, and near peripheral portions of the punch and die 51, 52 whose curvatures are larger than the other portions. While the portion of the material 56 corresponding to the punch 51 is eventually removed by a further piercing movement of the punch 51, the ruptured portions near the large-curvature portions of the punch 51 are left as burrs around the hole formed through the obtained pierced product, which burrs protrude beyond the back surface of the sheet 56 in the piercing direction.

Sometimes, a piercing operation is effected, with the workpiece sheet in an inclined attitude, while being placed on a die whose upper surface is inclined with respect to the horizontal direction perpendicular to the movement of an upper punch relative to the die. For holding the height of burrs left on the pierced product within a permissible or tolerable range (e.g., less than 0.1 mm), the percent of the clearance between the punch and the die with respect to the thickness of the workpiece sheet should be held within a relatively narrow range, as indicated in the graph of FIG. 12.

Further, the piercing operation on an inclined workpiece sheet as described above usually suffers from an interference of the punch with the die, due to a sliding force acting on the working end face of the punch which contacts the inclined surface of the workpiece sheet. If the sliding force exceeds a static friction force between the end face of the punch and the inclined surface of the sheet, the punch is forced to slide toward the lower portion of the edge of the die, whereby the outer periphery of the punch may eventually contact and thereby damage the die.

To avoid such interference between the punch and the die, the above-identified Japanese laid-open Publication No. 1-293922 proposes the application of chamfering of a punch to a piercing operation on an inclined workpiece sheet as described above. Namely, a punch 61 has an inclined lower working end face, while a die 62 has an inclined top surface parallel to the inclined punch end face, as shown in FIG. 13. The punch 61 has a chamfer 61*a* along the outer peripheral edge at the working end face, while the die 62 has a sharp edge 62*a*. The chamfered edge 61*a* of the punch 61 assures cracking of a workpiece sheet, at a portion near the sharp die edge 62*a*, so as to minimize the amount of burrs left on the obtained product, as described above. This arrangement is effective to reduce the burrs, without reducing the clearance between the punch and die 61, 62, and is therefore free from damage of the punch and die 61, 62 due to an interference therebetween.

However, the above arrangement also suffers from a drawback, which seems to occur due to a difference in angle formed by the inclined working end face of the punch 61 and the piercing direction of the punch, between the diametrically opposed portions of the outer periphery at the working end face of the punch. More specifically, the outer peripheral edge of the punch 61 has, at its lower and upper peripheral portions, an acute portion and an obtuse portion which form an acute and an obtuse angle with respect to the piercing direction, respectively. For easy understanding, the portions of the chamfer 61*a* formed at the acute and obtuse portions will be referred to as "acute side 68" and "obtuse side 69", respectively, which are indicated in FIG. 13.

A piercing operation effected by the punch 61 and the die 62 is illustrated in FIG. 14, in which reference numerals 63 and 64 denote a stripper and a workpiece sheet. It appears that a portion of the workpiece sheet 64 near the acute side 68 of the chamfer 61*a* of the punch 61 tends to easily crack and then rupture at a portion near the sharp die edge 62*a*, while a portion of the workpiece sheet 64 near the obtuse side 69 of the chamfer 61*a* tends to rupture at the portion near the sharp die edge 62*a*, before the same portion undergoes a sufficient degree of cracking due to shearing and tensile stresses. Consequently, it is considered that burrs are likely to be left at the portion of the sheet 64 near the obtuse side 69, due to the rupturing without the prior sufficient cracking starting from the surface on the side of the sharp edge 62*a*, which causes the ruptured portion to protrude from the back surface of the sheet 64 in the piercing direction. Thus, the pierced product tends to have burrs at the portion corresponding to the obtuse side 69 of the chamfer 61*a* of the punch 61.

SUMMARY OF THE INVENTION

It is therefore a first object of the present invention to provide a piercing die capable of performing a piercing operation with a minimum of burrs left on the obtained pierced product, even where the profile of a hole to be formed through the product has portions having different curvatures, or even where the working end face of the punch is inclined with respect to a direction perpendicular to the direction of movement of the punch relative to the die.

A second object of the invention is to provide a method which permits a piercing operation as described above with respect to the piercing die.

The above first object may be achieved according to a first aspect of this invention, which provides a piercing die including a punch and a die cooperating with each other to effect a piercing operation on a metallic workpiece sheet, the punch having an outer peripheral edge having a closed profile at a working end thereof, the piercing die being characterized in that the outer peripheral edge of the punch has a first and a second chamfered portion which are formed such that the amount of chamfer of the first chamfered portion is larger than that of the second chamfered portion.

Where the closed profile of the outer peripheral edge at the working end of the punch comprises a large-curvature portion such as a corner portion of a polygonal profile, and a small-curvature portion such as a straight portion of a polygonal profile, the first and second chamfered portions having the relatively large and small amounts of chamfer are formed along the large-curvature and small-curvature portions of the closed profile, respectively. According to this form of the invention, the portion of the workpiece sheet corresponding to the small-curvature portion of the profile of the outer peripheral edge of the punch tends to easily crack before rupturing, at a part near the sharp edge of the die, starting from the surface of the sheet on the side of the die, in the presence of the corresponding second chamfered portion of the punch. Thus, burrs are less likely to be left at a portion of a hole formed through the workpiece sheet (i.e., pierced product), which portion corresponds to the small-curvature portion of the punch profile.

Further, the present arrangement is also effective to minimize the amount of burrs left at a portion of the hole formed through the obtained product, which portion corresponds to the large-curvature portion of the punch profile. This advantage is derived from the larger amount of chamfer of the first chamfered portion of the punch corresponding to the large-curvature portion, than that of the second chamfered portion corresponding to the small-curvature portion. It appears that the larger amount of chamfer of the first chamfered portion of the punch results in reducing the tensile stress at the portion of the workpiece sheet near the first chamfered portion, and reducing the amount of decrease in the thickness at the same portion of the sheet. Consequently, the portions of the sheet near the large-curvature portions of the punch (and the die) tend to crack at a part near the sharp edge of the die, rather than at a part near the punch. Accordingly, the workpiece sheet is cut upon the following rupturing near the sharp die edge. While a large amount of burrs is left on the removed portion of the sheet, only a minimum amount of burrs is left on the edge of the hole formed through the pierced product, even at the portion of the hole corresponding to the large-curvature portion of the punch, owing to the larger amount of chamfer of the corresponding first chamfered portion of the peripheral edge of the punch.

Thus, the above arrangement of the first and second chamfered portions of the punch in relation to the large-curvature and small-curvature portion of the punch profile is effective to minimize the amount of burrs left on the obtained product, even where the hole to be formed through the product has a polygonal, elliptical or other non circular shape which have small- and large-curvature portions.

The above advantage may be obtained over a relatively wide range of the clearance between the punch and the die, more strictly, the percent of the clearance with respect to the workpiece thickness. This means that the punch may have a relatively large tolerance in the external dimension, with respect to the internal dimension of the die, whereby the punch and the die may be manufactured at a relatively reduced cost, with a relatively high degree of relative dimensional freedom or tolerance.

According to another form of the invention, the face of the working end of the punch defined by the closed profile, and the surface of the die in which the die hole is open, are inclined with respect to the horizontal direction, namely, with respect to the direction perpendicular to the direction of a piercing movement of the punch relative to the die, so that the outer peripheral edge of the punch has an acute portion and an obtuse portion which for respectively an acute angle and an obtuse angle with respect to the direction of the piercing movement. The first and second chamfered portions having the relatively large and small amounts of chamfer are formed at the acute and obtuse portions of the peripheral edge of the punch, respectively.

In the above arrangement, the portion of the inclined workpiece sheet corresponding to the obtuse portion of the outer peripheral edge of the punch tends to easily crack before rupturing, at a part near the sharp edge of the die, starting from the surface of the sheet on the side of the die, in the presence of the corresponding second chamfered portion of the punch. Thus, burrs are less likely to be left at a portion of a hole formed through the workpiece sheet (i.e., pierced product), which portion corresponds to the obtuse portion of the punch periphery.

Further, the instant arrangement makes it possible to minimize the amount of burrs left at a portion of the hole formed through the obtained product, which portion corresponds to the acute portion of the punch. This advantage is derived from the larger amount of chamfer of the first chamfered portion of the punch corresponding to the acute portion, than that of the second chamfered portion corresponding to the obtuse portion. It appears that the larger amount of chamfer of the first chamfered portion of the punch results in reducing the shearing stress at the portion of the workpiece sheet near the first chamfered portion, and reducing and delaying a decrease in the thickness at the same portion of the sheet. Consequently, the portion of the sheet near the acute portion of the punch (and the die) tends to crack at a part near the sharp edge of the die, rather than at a part near the punch. Accordingly, the workpiece sheet is cut upon the following rupturing near the sharp die edge. Accordingly, only a minimum amount of burrs is left on the edge of the hole formed through the pierced product, even at the portion of the hole corresponding to the acute portion of the punch, owing to the larger amount of chamfer of the corresponding first chamfered portion of the peripheral edge of the punch.

Thus, the above arrangement of the first and second chamfered portions of the punch in relation to the large-curvature and small-curvature portion of the punch profile is effective to minimize the amount of burrs left on the obtained product, even where the end face of the punch is included so as to provide an acute and an obtuse portion with respect to the piercing direction.

The second object indicated above may be accomplished according to a second aspect of this invention, which provides a method of effecting a piercing operation on a metallic workpiece sheet, comprising the steps of: moving a punch and a die relative to each other in a piercing direction, the punch having an outer peripheral edge having a closed profile at a working end thereof, the outer peripheral edge of the punch having a first and a second chamfered portion which are formed such that an amount of chamfer of the first chamfered portion is larger than that of the second chamfered portion; and selecting a clearance between the punch and the die, so as to be within a range of 5-50% of a thickness of the workpiece sheet.

The method of the invention provides the same advantage as described with the piercing die whose punch has the first and second chamfered portions.

BRIEF DESCRIPTION OF THE DRAWINGS

The above and optional objects, features and advantages of the present invention will become more apparent by reading the following detailed description of presently preferred embodiments of the invention, when considered in connection with the accompanying drawings, in which.

DETAILED DESCRIPTION OF THE PREFERRED EMBODIMENTS

Figure 1:
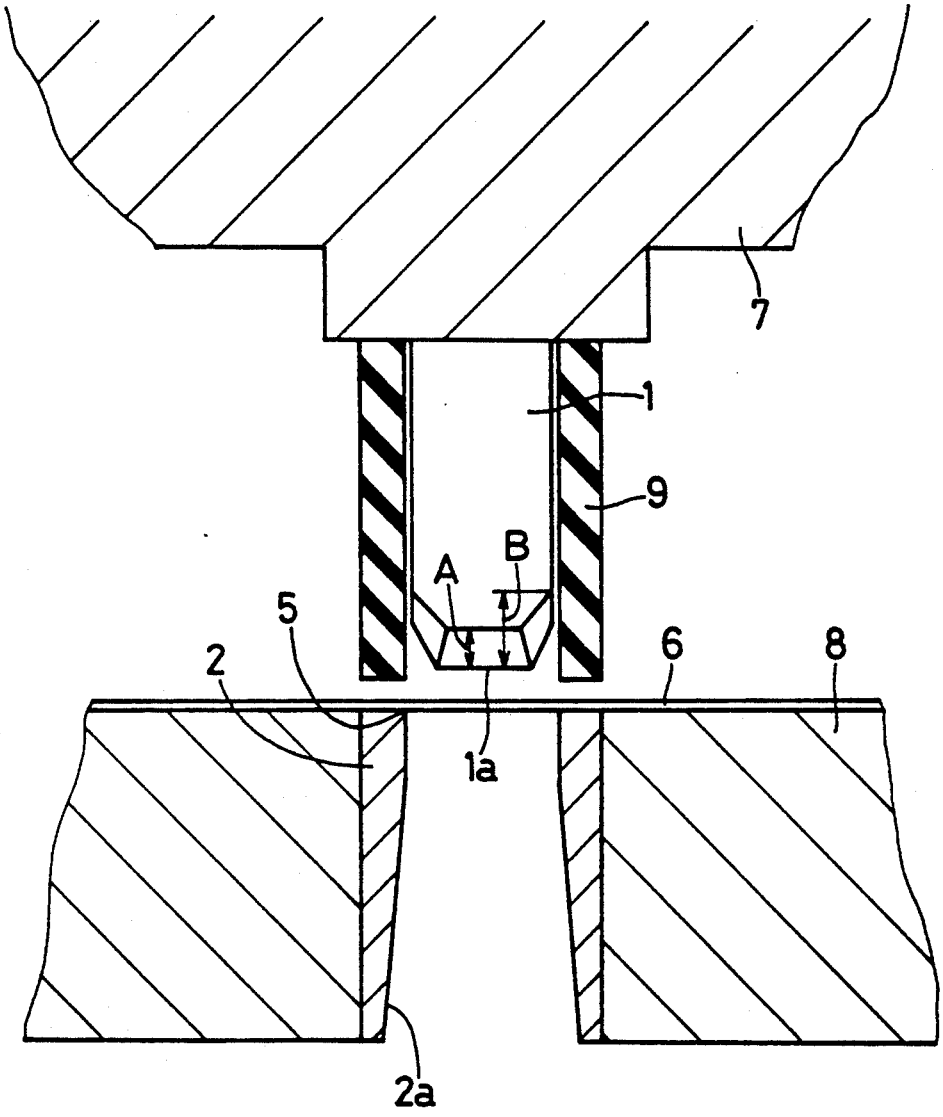
FIG. 1 is a front elevational view in cross section of a piercing die constructed according to one embodiment of the present invention.
Figure 2:
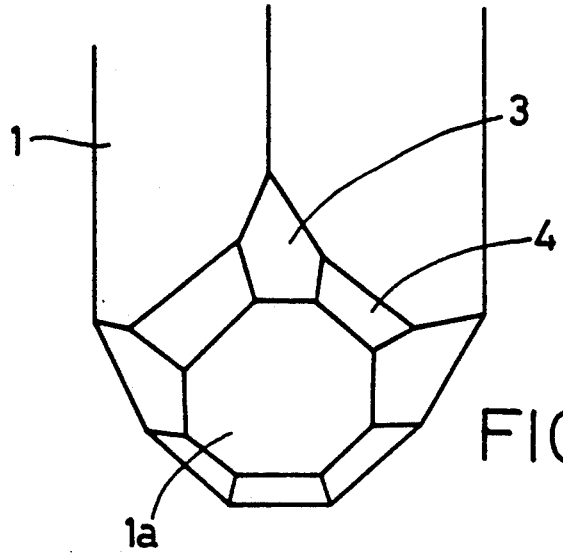
FIG. 2 is a perspective view of the punch used in the piercing die of FIG. 1.

Referring first to FIGS. 1 and 2, there is shown one embodiment of a piercing die of the present invention, which is adapted to perform a piercing operation on a metallic workpiece in the form of a strip 6, to obtain a product in the form of the strip 6 having a square hole formed by removal of the corresponding square portion of the strip 6 as a scrap.

The piercing die includes a punch block 7 which is fixed to a ram which is reciprocable in the vertical direction by a suitable drive mechanism, as well known in the art. The piercing die further includes a die block 8 which is disposed below the punch block 7 and fixed to a stationary bolster, as also well known in the art.

The punch block 7 carries a punch 1 fixed to the underside thereof so as to extend toward the die block 8. The punch 1 is a square prism having a lower working end, thus defining a square profile in a transverse cross section in a plane perpendicular to the direction of movement of the punch. The punch block 7 also carries a tubular stripper 9 fixed thereto so as to surround the punch 1. In operation, the stripper 9 serves to force the metal strip 6 against the die block 8 during a piercing operation, and remove the strip 6 from the punch 1 at the end of the piercing operation.

The stripper 9 is formed of an elastic material such as urethane or other rubber material, and has a lower end which is normally located a small distance away from the end face 1*a* of the punch 1 in the downward direction. When the punch block 7 is lowered to move the punch 1 into the die block 8, the stripper 9 is compressed by the punch block 7, against the metal strip 6. When the punch 1 is pulled up from the die block 8, the stripper 9 serves to hold the strip 6 and thereby separate the strip 6 from the punch 1 as the stripper 9 is elastically expanded to the original state.

The die block 8 has a die 2 fixed therein. The die 2 has a die hole 2*a* having a cross sectional shape corresponding to the square outer profile of the punch 1. The die hole 2*a* is open at its upper end in the top surface of the die block 8. The opening of the die hole 2*a* is defined by a relatively sharp edge 5, which will be referred to as "die edge 5" where appropriate.

The square outer peripheral edge at the lower working end of the punch 1 is chamfered, as shown in FIG. 2, so as to define a closed outer profile, and an octagon inner edge which defines the periphery of an octagon end face 1*a*. The chamfered peripheral edge consists of a first chamfered portion in the form of four corner chamfers 3, and a second chamfered portion in the form of four side chamfers 4. The corner chamfers 3 are formed at the corners of the square prism of the punch 1, and the side chamfers 4 are at the four straight sides of the prism, each side chamfer 4 connecting the adjacent corner chamfer 3.

All of the corner and side chamfers 3, 4 are formed at the same angle, for example, 45° with respect to the end face 1*a*. However, the corner chamfer 3 and the side chamfers 4 have different amounts. Namely, the amount of the corner chamfers 3 is larger than that of the side chamfers 4. An experiment showed a good result when the amount of each corner chamfer 3 is 2–3 times that of each side chamfer 4. In this arrangement, the end of each corner chamfer 3 remote from the end face la in the longitudinal or piercing direction of the punch 1 is spaced a suitable distance away from the corresponding end of each side chamfer 4 in the longitudinal direction of the punch 1.

When a piercing operation is effected on the metal strip 6 placed on the die block 8, the punch block 7 is first lowered with the punch 1 and the stripper 9, and the lower end of the stripper 9 comes into abutting contact with the upper surface of the strip 6. As the punch block 7 is further lowered, the stripper 9 is elastically compressed so as to increase the force by which the strip 6 is pressed against the die block 8, and the punch 1 starts a piercing action in coöperation with the die 2.

In a piercing operation by the known piercing die of FIGS. 8–11 in which the outer peripheral edge at the working end of the punch 51 is chamfered by the same angle over the entire periphery, the portions of the strip 56 near the corner portions of the chamfered edge of the punch 51 do not undergo cracking near the sharp edge 55 of the die 52, and tend to rupture near the corners of the chamfered edge of the punch 1, before cracking and rupture occur near the sharp die edge 55, whereby a considerable amount of burrs are left on the pierced strip 56.

Figure 3:
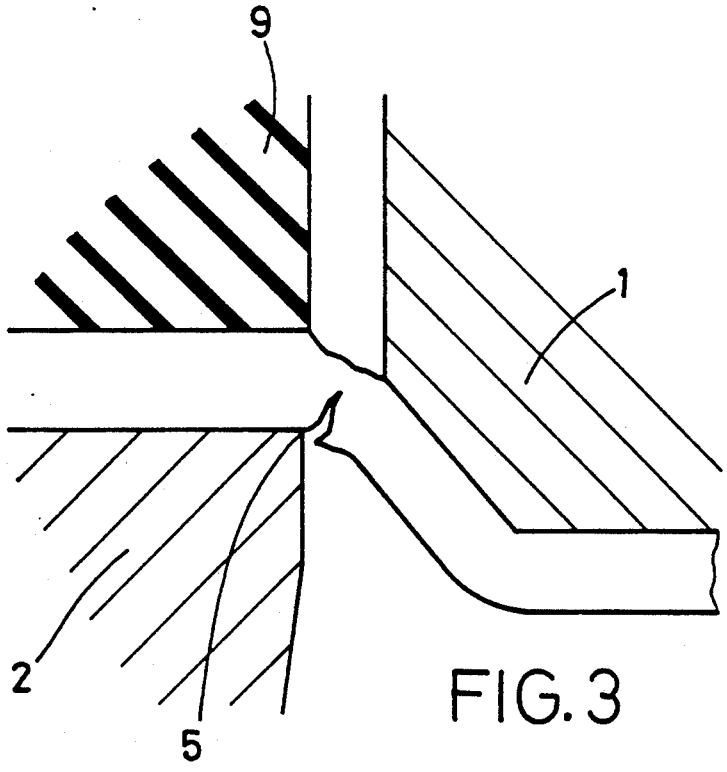
FIG. 3 is a fragmentary cross sectional illustration showing a piercing operation on a workpiece sheet, which is performed by the piercing die of FIG. 1.

In the piercing operation by the present piercing die of FIGS. 1 and 2, on the other hand, the metal strip 6 will first crack and then rupture near the sharp die edge 5, as indicated in FIG. 3, before cracking and rupturing of the strip 6 occur near the periphery of the punch 1, even at the corner portions of the punch 1, since the corner chamfers 3 formed at those corner portions have a larger amount of chamfer than the side chamfers 4.

Thus, the pierced strip 6 has substantially no burrs or only a small amount of burrs.

The above advantage appears to result from an effect of the corner chamfers 3 of reducing tensile stress which act on the portions of the strip 6 near the corner chamfers 3, and reducing or delaying a decrease in the thickness of the strip 6 at those portions. This presumed phenomenon appears to permit the strip 6 to crack starting from the lower surface, near the corner portions of the sharp die edge 5, as shown in FIG. 3, rather than near the corner chamfers 3 of the punch 1.

Figure 4:
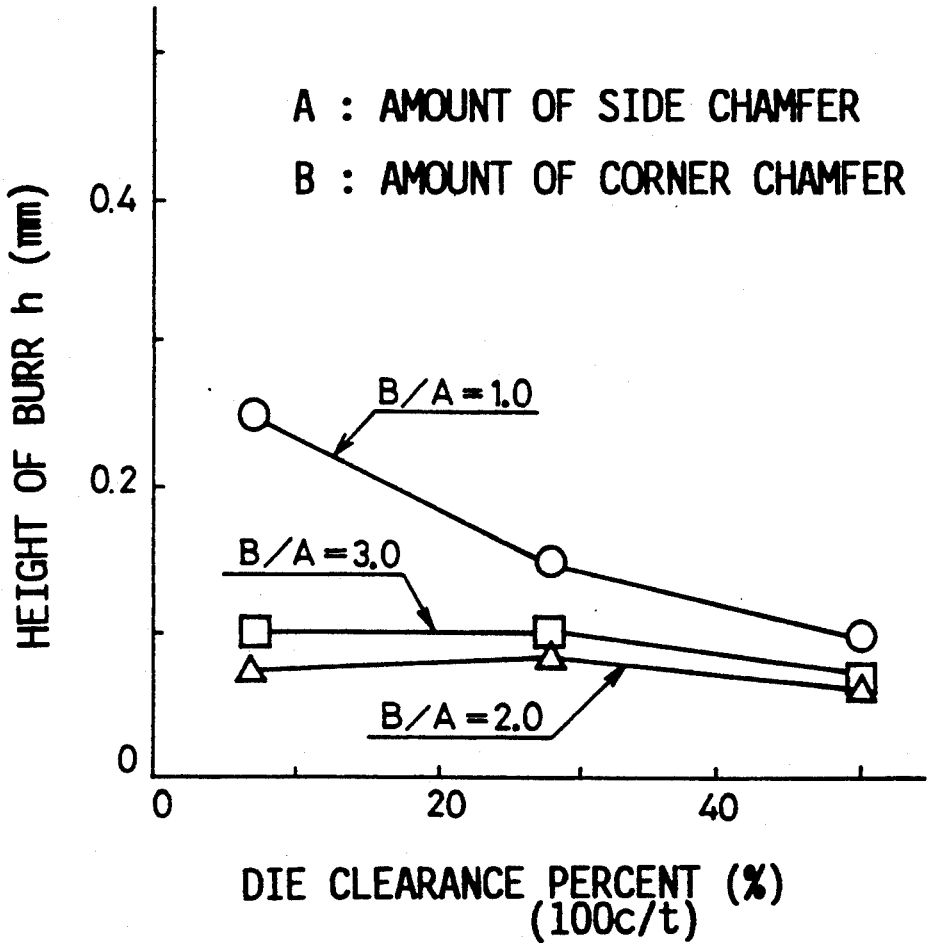
FIG. 4 is a graph indicating relationships between the height of burrs left on the workpiece sheet pierced by the piercing die of FIG. 1 and the clearance percent of the piercing die, which are obtained with different ratios of corner chamfer amount to side chamfer amount of the punch.

The reduced amount of burrs left on the strip 6 pierced by the present piercing die was confirmed by an experiment in which the height of burrs left on the pierced product was measured in relation to the clearance percent, i.e., percent of the die clearance with respect to the thickness of the workpiece sheet. In the experiment, there were used three different piercing dies, one comparative specimen as shown FIGS. 8-11, and two specimens as shown in FIGS. 1-3 according to the present invention. The graph of FIG. 4 shows the result of the experiment, wherein "A" represents the amount of chamfer of the side chamfers 4, while "B" represents the amount of chamfer of the corner chamfers 3, which are not provided in the comparative specimen.

The specimen whose ratio B/A is equal to 1.0 is the comparative specimen, while the specimens whose ratios B/A are equal to 2.0 and 3.0, respectively, are examples according to the present invention. It will be understood from the graph of FIG. 4 that the two examples according to the invention exhibited better results than the comparative example, in the amount of burrs left, i.e., as measured in terms of the height of burrs, over a wide range of the die clearance percent (%) = 100 c/t, where c amount of clearance between the punch and die 1, 2, and t = thickness of the workpiece sheet (strip 6, 56). More specifically, the height of burrs is held not larger than 0.1 mm over the clearance percent range of 5-50%. The better results of the two examples according to the invention are believed to be obtained owing to the provision of the corner chamfers 3 whose amount of chamfer is two or three times that of the side chamfers 4.

Figure 5:
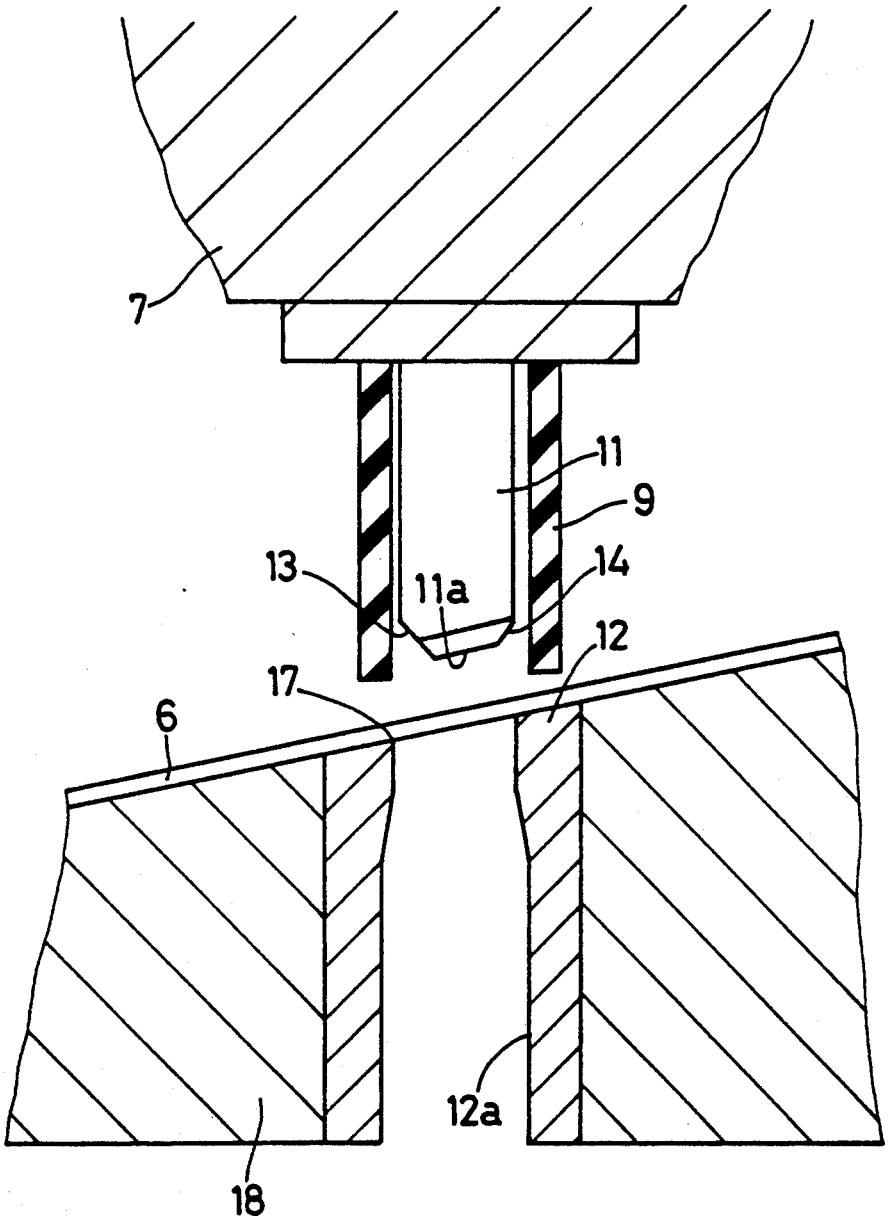
FIG. 5 is a front elevational view in cross section of a piercing die constructed according to another embodiment of this invention.
Figure 6:
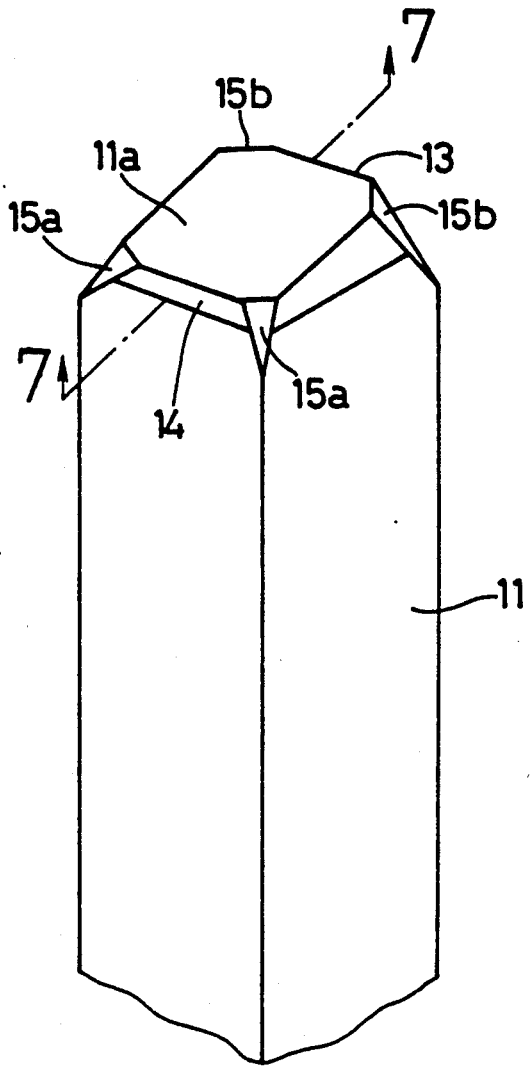
FIG. 6 is a perspective view of the punch used in the piercing die of FIG. 5.
Figure 7:
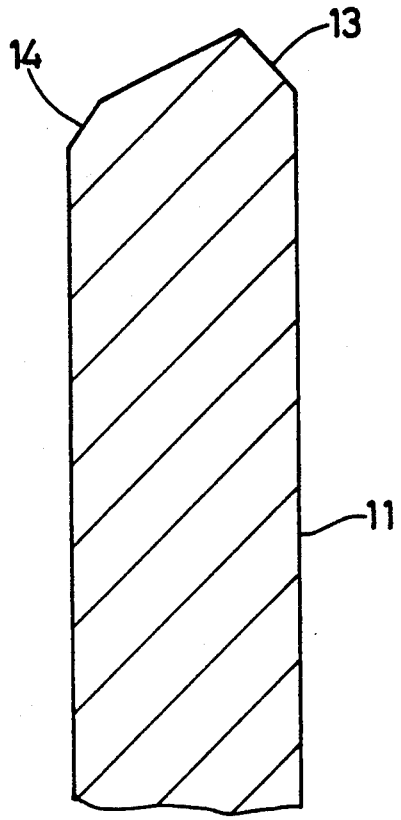
FIG. 7 is a cross sectional view taken along line 7—7 of FIG. 6.
Figure 8:
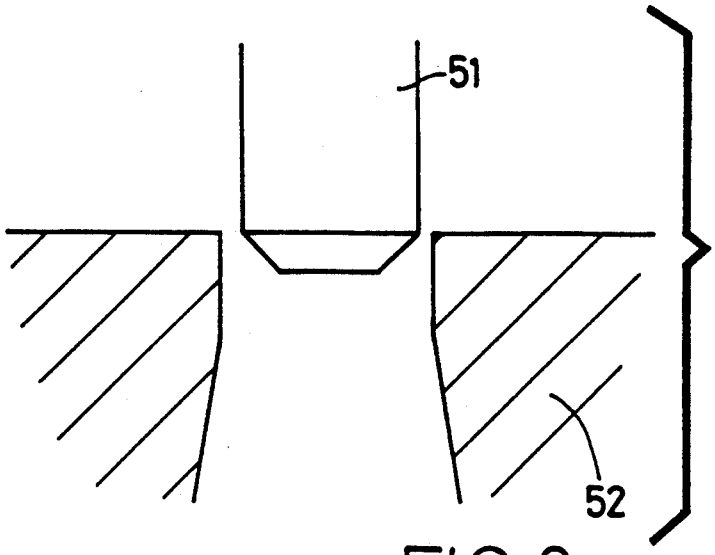
FIG. 8 PRIOR ART
FIG. 8 is a front elevational view of a known piercing die.
Figure 9:
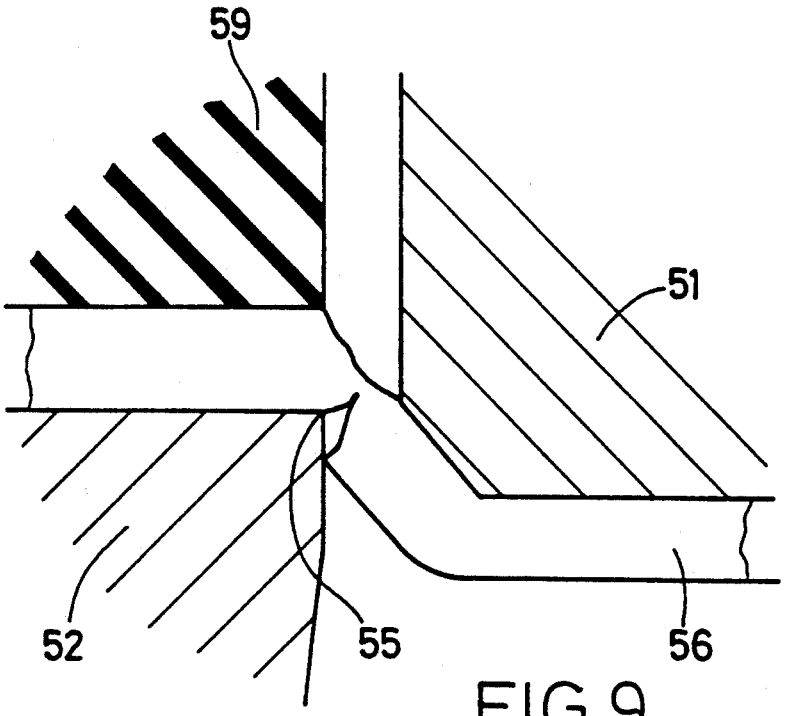
FIG. 9 PRIOR ART
FIG. 9 is a fragmentary cross sectional illustration showing a piercing operation on a workpiece sheet, performed by the piercing die of FIG. 8.
Figure 10:
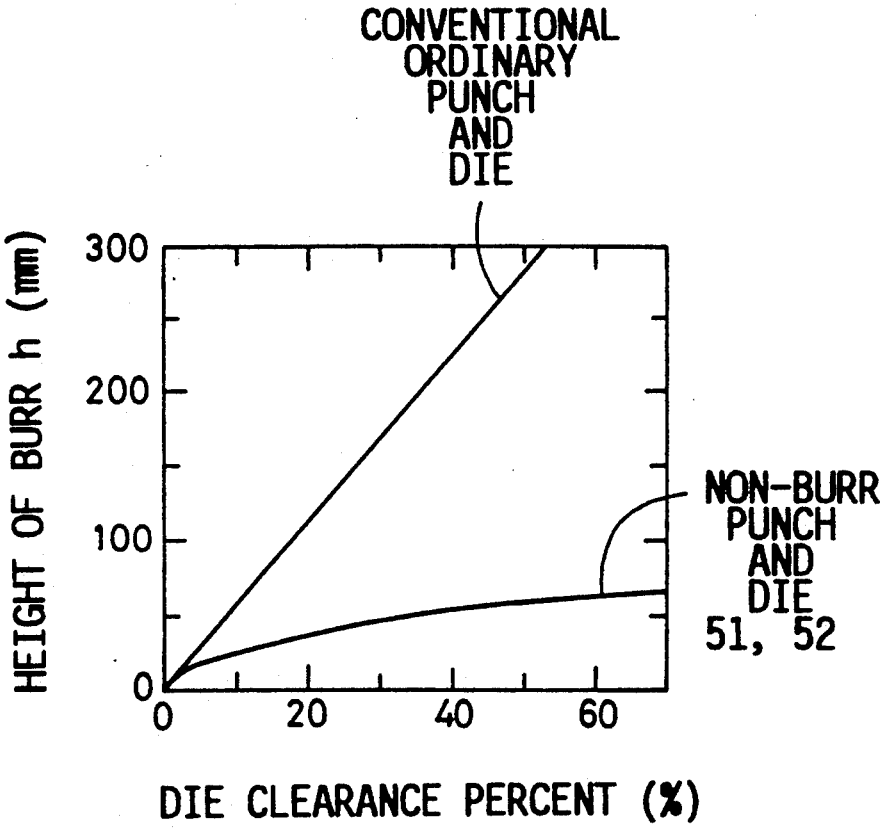
FIG. 10 PRIOR ART
FIG. 10 is a graph showing relationships between the height of burrs left on the pierced workpiece sheet and the clearance percent, which are obtained by the known piercing die of FIG. 8 and a conventional ordinary piercing die.
Figure 11:
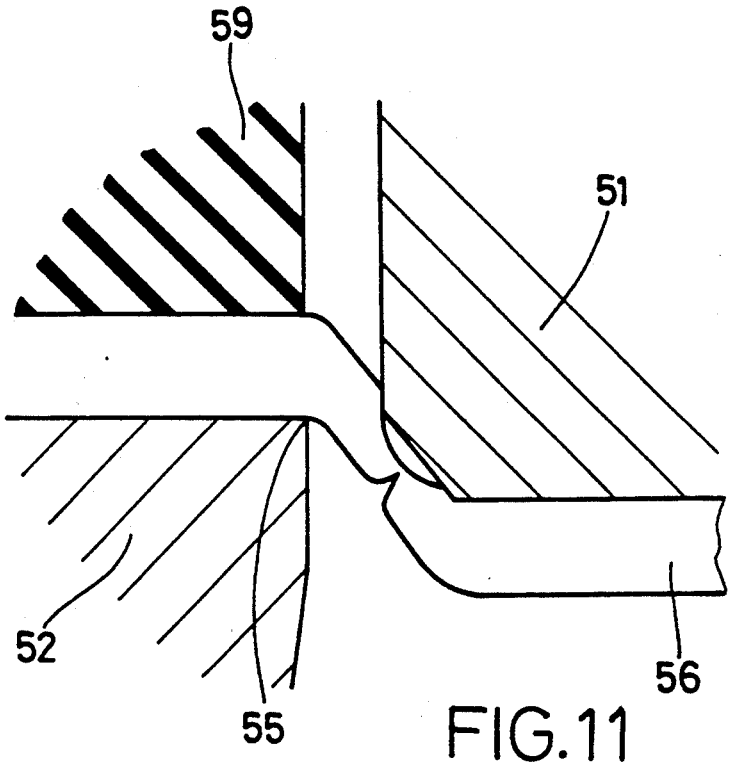
FIG.11 PRIOR ART
FIG. 11 is a fragmentary cross sectional illustration showing a piercing operation at a portion of the outer peripheral profile of the punch of the piercing die of FIG. 8, which portion has a relatively large curvature.
Figure 12:
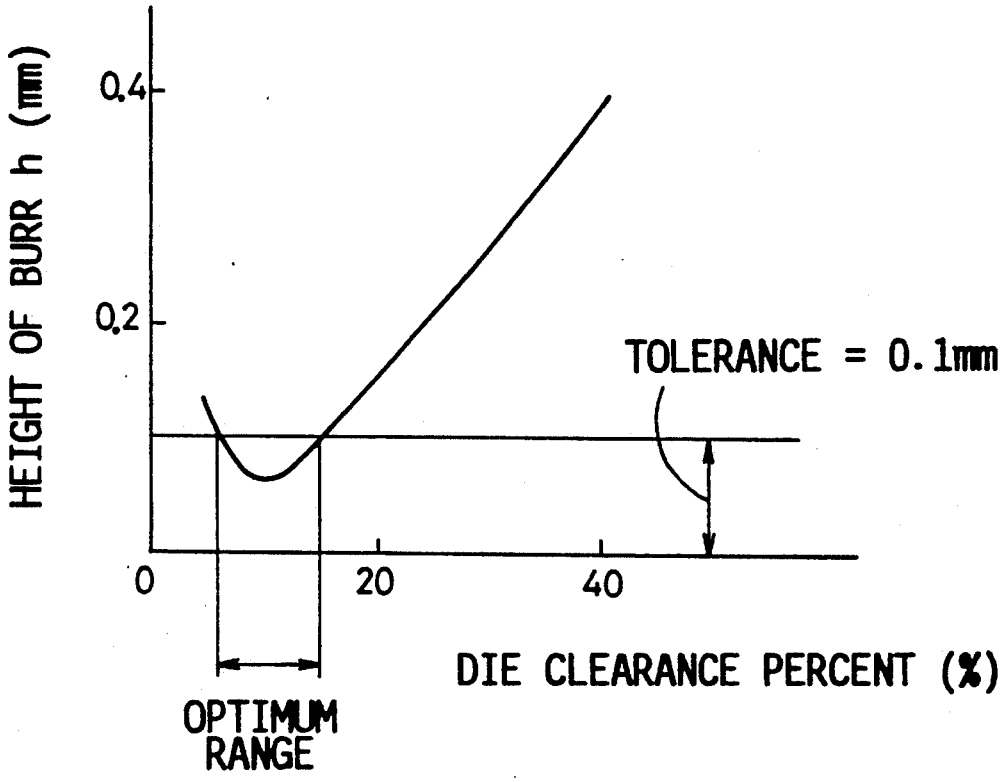
FIG. 12 PRIOR ART
FIG. 12 is a graph showing a relationship between the height of burrs left on a workpiece sheet pierced by a conventional piercing die with the sheet held in an inclined attitude, and the clearance percent of the piercing die.

Referring next to FIGS. 5-7, there will be described another embodiment of the present invention.

As shown in FIG. 5, the present modified piercing die uses a punch 11 fixed to the punch block 7, and a die 12 fixed in a die block 18 whose top surface is inclined at a suitable small angle with respect to the horizontal direction (perpendicular to the direction of the piercing movement of the punch 11). In operation, the metal strip 6 is placed on the inclined top surface of the die block 18.

Unlike the punch 1 used in the preceding embodiment, the punch 11 also accommodated in the stripper 9 has an inclined working end face 11*a*, which is parallel to the top surface of the die block 18. The die 12 has an inclined upper end face which forms a part of the inclined surface of the die block 18. The die 12 has a die hole 12*a* whose upper end is defined by a sharp edge 17.

While the outer peripheral edge at the working end of the punch 11 is chamfered as described below, the inclination of the end face 11 gives the working end an acute portion and an obtuse portion which form respectively an acute angle and an obtuse angle with respect to the direction of the piercing movement (vertical or longitudinal direction) of the punch 11. These acute and obtuse portions give the chamfered peripheral edge an acute side 13 on one side of the end face 11*a*, namely, on the lower side as seen in FIG. 5, and an obtuse side 14 on the opposite upper side of the end face 11*a*, as also shown in FIGS. 6 and 7.

As in the preceding embodiment, the chamfered outer peripheral edge at the working end of the punch 11 includes four side chamfers two of which are indicated at 3, 14 as the acute and obtuse sides, and four corner chamfers 15*a*, 15*b*. The amount of each side chamfer (13, 14) is smaller than the adjacent corner chamfers 15*a*, 15*b*. The angle of chamfering is 45° with respect to the side surfaces of the square prism of the punch 11.

Further, the amount of chamfer on the acute side 13 is larger than that on the obtuse side 14. An experiment showed a good result if the amount of chamfer on the acute side is 1.5-3 times that on the obtuse side 14. If the amount of chamfer on the acute side 13 is less than 1.5 times that on the obtuse side, the strip 6 tends to have a considerable amount of burrs at a portion of a square hole formed by a piercing operation, which portion corresponds to the acute side 13. If the amount of chamfer on the acute side 13 is more than 3 times that on the obtuse side 14, a good result cannot be expected, due to a geometrical limitation of the punch 11.

Since the amount of chamfer on the acute side 13 is larger than that on the obtuse side 14, the amount of the corner chamfers 15*b* on the acute side 13 is larger than that of the corner chamfers 15*a* on the obtuse side 14.

In a piercing operation by the present piercing die, the corner chamfers 15*a*, 15*b* have an effect similar to the effect provided by the corner chamfers 3 in the preceding embodiment, which has been described above.

Figure 13:
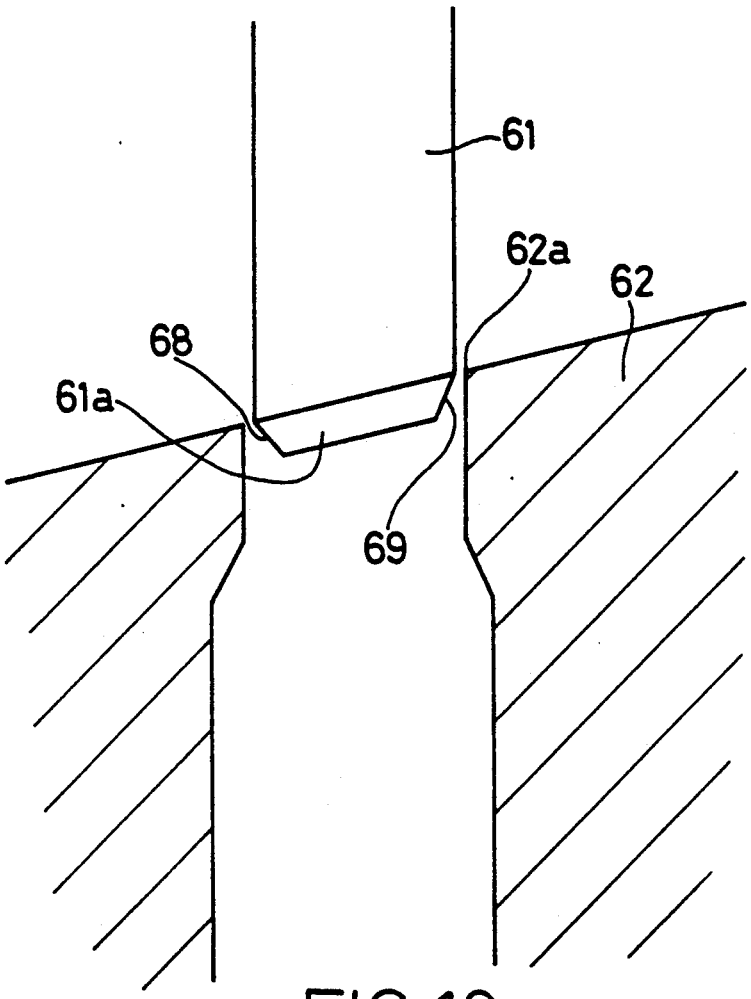
FIG. 13 PRIOR ART
FIG. 13 is a front elevational view showing a known piercing die whose punch has an inclined end face and a chamfered peripheral edge.
Figure 14:
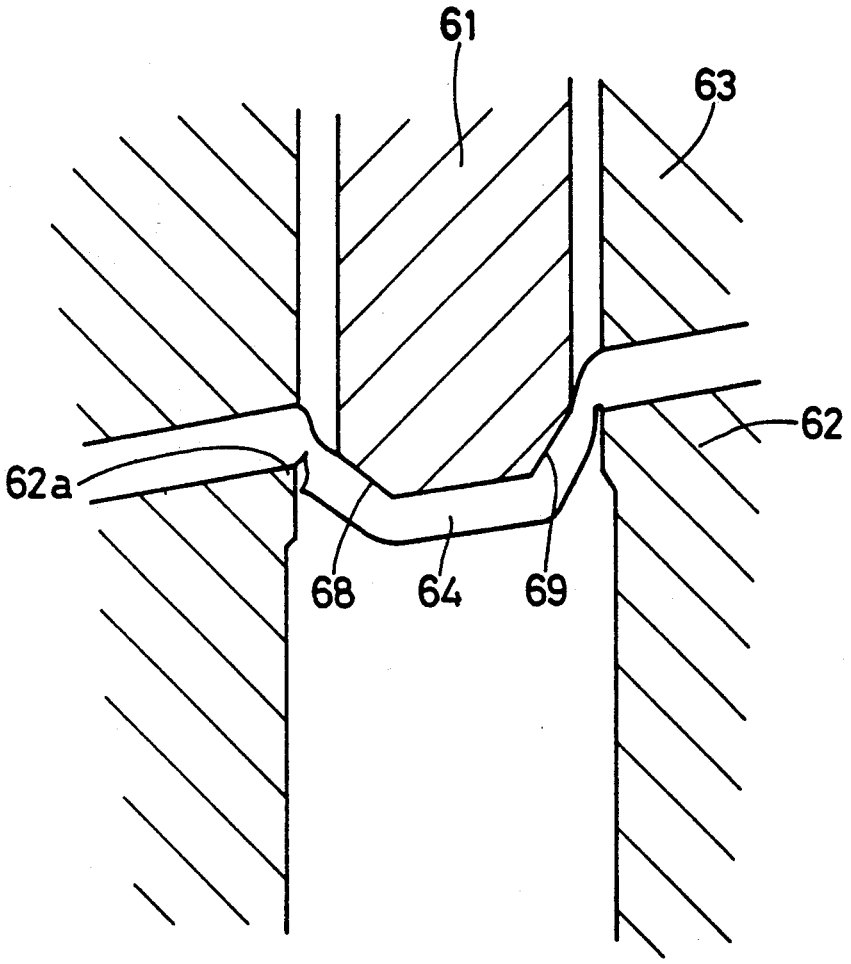
FIG.14 PRIOR ART
FIG. 14 is a cross sectional illustration showing a piercing operation by the piercing die of FIG. 13.

Further, the larger amount of chamfer on the acute side 13 than on the obtuse side 14 is effective to eliminate the drawback experienced by the known piercing die of FIGS. 13 and 14. That is, the relatively large acute side chamfer 13 serves to reduce the tensile stress acting on the portion of the metal strip 6 near the acute side 13 and reduce and delay a decrease in the thickness of that portion of the strip 6, whereby the portion of the strip 6 near the acute side 13 first cracks and then ruptures at a part near the sharp die edge 17, rather than a part near the acute side 13 of the punch 11. This cracking and rupturing of the strip 6 on the acute side will take place at substantially the same time as the cracking and rupturing on the obtuse side 14. Thus, burrs are less likely to be left on the pierced strip 6, irrespective of the acute and obtuse sides 13, 14 of the chamfered peripheral edge of the punch 11.

As in the preceding embodiment, the above advantage may be obtained over a relatively wide range of the die clearance. Accordingly, the punch may have a relatively large tolerance in the external dimension, with respect to the internal dimension of the die, whereby the punch and the die may be manufactured at a relatively reduced cost, with a relatively high degree of relative dimensional freedom or tolerance.

While the present invention has been described in its presently preferred embodiments with a certain degree of particularity, it is to be understood that the invention is not limited to the details of the illustrated embodiments, but may be embodied with various changes, modifications and improvements, which may occur to those skilled in the art, in the light of the foregoing teaching.

For example, the punch 1, 11 and the die 2, 12 may be modified to form a hole having any desired profile other than a square or rectangle, such as an elliptical hole or polygonal hole. In this respect, it is noted that like an ellipse having portions with different curvatures, a rectangular or polygonal profile can be considered to have different curvatures, e.g., a portion of small curvature in the regions of the side chamfers 4, 13, 14, and a portion of large curvature in the regions of corner chamfers 3, 15*a*, 15*b*, respectively, the large curvature portions having a larger curvature than the small-curvature portion. Thus, any polygon can be considered to have a closed non-circular profile consisting of a large-curvature portion (corner portions) and a small-curvature portion (straight side portions).

Further, the specific dimensional and geometrical features at the working end of the punch 1, 11 may be modified as needed, as long as the modifications meet the principle and spirit of the invention defined in the following claims.

What is claimed is:

1. A piercing die including a punch and a die cooperating with each other to effect a piercing operation for forming a non-circular hole through a metallic workpiece sheet, said punch having at a working end thereof an outer peripheral edge having a non-circular profile similar to the non-circular hole, said non-circular profile of said outer peripheral edge comprising a large-curvature portion, and a small-curvature portion which has a smaller curvature than said large-curvature portion, wherein the improvement comprises:

said outer peripheral edge of said punch having first and second chamfered portions formed at said large-curvature and small-curvature portions of said non-circular profile, respectively, such that said first chamfered portion has a larger chamfer than said second chamfered portion.

2. A piercing die according to claim 1, wherein said punch has a polygonal profile in cross section in a plane perpendicular to a direction of a piercing movement of said punch relative to said die, and said large-curvature portion of said non-circular profile corresponds to each of corner portions of said polygonal profile, while said small-curvature portion of said non-circular profile corresponds to each of straight portions of said polygonal profile.

3. A piercing die according to claim 2, wherein said polygonal profile is a rectangle.

4. A piercing die according to claim 2, wherein the amount of chamfer of said first chamfered portion at each said corner portion is 2–3 times that of said second chamfered portion at east said straight portion.

5. A piercing die according to claim 4, wherein said first and second chamfered portions are chamfered at 45° with respect to a direction of a piercing movement of said punch relative to said die.

6. A piercing die according to claim 1, wherein said working end of said punch has an end face defined by inner peripheries of said first and second chamfered portions, and said die having a die hole and a surface in which said die hole is open, said end face of said working end of said punch and said surface of said die being inclined with respect to a direction perpendicular to a direction of a piercing movement of said punch relative to said die, whereby said outer peripheral edge of said punch has an acute portion and an obtuse portion which form respectively an acute angle and an obtuse angle with respect to said direction of said piercing movement, said acute portion having a larger amount of chamfer than said obtuse portion, each of said acute and obtuse portions having a larger amount of chamfer at said large-curvature portion, than at said small-curvature portion.

7. A piercing die including a punch and a die cooperating with each other to effect a piercing operation for forming a hole through a metallic workpiece sheet, said punch having a working end with an outer peripheral edge having a profile similar to the hole, said working end of said punch having an end face, and said die having a die hole, and a surface at which said die hole opens, said end face of said punch and said surface of said die being inclined with respect to a plane perpendicular to a direction of a piercing movement of said punch relative to said die, whereby said outer peripheral edge of said punch has an acute portion and an obtuse portion which form respectively an acute angle and an obtuse angle with respect to said direction of said piercing movement, wherein the improvement comprises:

said outer peripheral edge of said punch having first and second chamfered portions formed at said acute and obtuse portions, respectively, such that said first chamfered portion has a larger chamfer than said second chamfered portion.

8. A piercing die according to claim 7, wherein the amount of chamfer of said first chamfered portion having said acute angle is 1.5–3 times that of said second chamfered portion having said obtuse angle.

9. A piercing die according to claim 7, wherein said first and second chamfered portions are chamfered at 45° with respect to a direction of a piercing movement of said punch relative to said die.

10. A piercing method for effecting a piercing operation using a punch and a die to form a non-circular hole through a metallic workpiece sheet having a thickness, said piercing method comprising the steps of: selecting said punch having a working end with an outer peripheral edge having a non-circular profile similar to the non-circular hole, said non-circular profile of said outer peripheral edge comprising a large-curvature portion and a small-curvature portion which has a smaller curvature than said large-curvature portion, said outer peripheral edge of said punch having first and second chamfered portions formed at said large-curvature and small-curvature portions of said non-circular profile, respectively, such that said first chamfered portion has a larger chamfer than said second chamfered portion;

moving said punch and said die relative to each other in a piercing direction; and selecting a clearance between said punch and said die, to be within a range of 5–50% of the thickness of said workpiece sheet.

11. A piercing method for effecting a piercing operation using a punch and a die to form a hole through a metallic workpiece sheet having a thickness, said piercing method comprising the steps of; selecting said punch having a working end with an outer peripheral edge having a profile similar to the hole, said working end of said punch having an end face, and said die having a die hole and a surface through which said die hole opens, said end face of said punch and said surface of said die being inclined with respect to a plane perpendicular to a direction of a piercing movement of said punch relative to said die, whereby said outer peripheral edge of said punch has an acute portion and an obtuse portion which form respectively an acute angle and an obtuse angle with respect to said direction of said piercing movement, said outer peripheral edge of said punch having first and second chamfered portions formed at said acute and obtuse portions, respectively, said first chamfered portion having a larger chamfer than said second chamfered portion;

moving said punch and said die relative to each other in a piercing direction; and selecting a clearance between said punch and said die to be within a range of 5–50% of the thickness of said workpiece sheet.

* * * * *

UNITED STATES PATENT AND TRADEMARK OFFICE

CERTIFICATE OF CORRECTION

PATENT NO. : 5,235,881

DATED : August 17, 1993

INVENTOR(S) : Kazuhiro SANO et al.

It is certified that error appears in the above-identified patent and that said Letters Patent is hereby corrected as shown below:

Claim 4, column 11, line 52, "east" should read --each--.

Claim 11, column 12, line 58, "of;" should read --of:--.

Signed and Sealed this

Fifteenth Day of March, 1994

*Attest:*

*Attesting Officer*

BRUCE LEHMAN

*Commissioner of Patents and Trademarks*